US008855515B2

(12) United States Patent
Tanaka

(10) Patent No.: US 8,855,515 B2
(45) Date of Patent: Oct. 7, 2014

(54) CONTROL APPARATUS AND METHOD, IMAGE FORMING APPARATUS AND SYSTEM, AND NON-TRANSITORY COMPUTER READABLE MEDIUM

(75) Inventor: Satoshi Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 199 days.

(21) Appl. No.: 13/478,643

(22) Filed: May 23, 2012

(65) Prior Publication Data

US 2013/0164010 A1 Jun. 27, 2013

(30) Foreign Application Priority Data

Dec. 22, 2011 (JP) ..... 2011-281783

(51) Int. Cl.
*G03G 15/16* (2006.01)

(52) U.S. Cl.
USPC ..... 399/66

(58) Field of Classification Search
USPC ..... 399/66, 313, 314
See application file for complete search history.

(56) References Cited

U.S. PATENT DOCUMENTS 5,966,560 A * 10/1999 Kodama et al. ..... 399/66
2009/0185206 A1* 7/2009 Uemura et al. ..... 358/1.9
2011/0255892 A1* 10/2011 Aoki ..... 399/66

FOREIGN PATENT DOCUMENTS

JP A-8-83006 3/1996
JP A-2010-8494 1/2010

* cited by examiner

*Primary Examiner* — Gregory H Curran
(74) *Attorney, Agent, or Firm* — Oliff PLC

(57) ABSTRACT

A control apparatus includes the following elements. A page specifying unit specifies, concerning image data representing images included in plural pages, among the plural pages, plural pages including images each having a similarity which is equal to or greater than a predetermined threshold. A controller controls a transfer bias to be applied to a transfer device which transfers a toner image formed on an image carrier onto a medium. The controller performs control, for the plural pages specified by the page specifying unit, such that each of values of the transfer bias to be applied to the transfer device when toner images corresponding to the plural pages specified by the page specifying unit are transferred onto the medium is within a predetermined range.

7 Claims, 12 Drawing Sheets

| PRINT DATA ID | PAGE NUMBER | TRANSFER BIAS VALUE |
|---|---|---|
| 0001 | 0001 | -10V |
| | 0002 | -10V |
| | ⋮ | ⋮ |
| | 0100 | -10V |
| 0002 | 0001 | +5V |
| | 0002 | -5V |
| | ⋮ | ⋮ |
| | 0050 | +10V |
| ⋮ | ⋮ | ⋮ |

CONTROL APPARATUS AND METHOD, IMAGE FORMING APPARATUS AND SYSTEM, AND NON-TRANSITORY COMPUTER READABLE MEDIUM

CROSS-REFERENCE TO RELATED APPLICATIONS

This application is based on and claims priority under 35 USC 119 from Japanese Patent Application No. 2011-281783 filed Dec. 22, 2011.

BACKGROUND (i) Technical Field

The present invention relates to a control apparatus and method, an image forming apparatus and system, and a non-transitory computer readable medium.

(ii) Related Art

In an electrophotographic image forming apparatus, the optimal transfer output when transferring toner images onto paper varies depending on the total amount of toner transferred onto paper. For example, the optimal value of the transfer output of a toner layer made up of multiple colors is greater than that of a toner layer made up of a single color. Accordingly, a technique for setting the optimal transfer output for each page in accordance with the total amount of toner for forming images to be output has been proposed.

SUMMARY

According to an aspect of the invention, there is provided a control apparatus including: a page specifying unit that specifies, concerning image data representing images included in plural pages, among the plural pages, plural pages including images each having a similarity which is equal to or greater than a predetermined threshold; and a controller that controls a transfer bias to be applied to a transfer device which transfers a toner image formed on an image carrier onto a medium, and that performs control, for the plural pages specified by the page specifying unit, such that each of values of the transfer bias to be applied to the transfer device when toner images corresponding to the plural pages specified by the page specifying unit are transferred onto the medium is within a predetermined range.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the accompanying drawings.

1. First Exemplary Embodiment

1-1. Configuration

Figure 1:
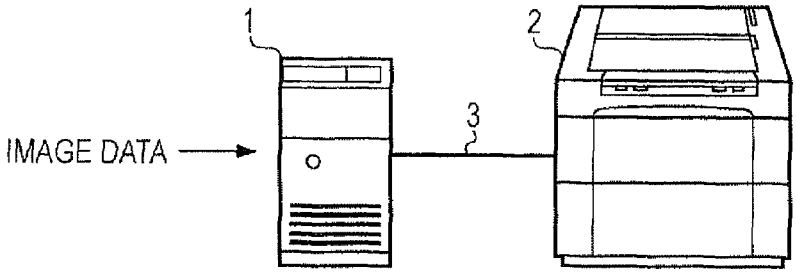
FIG. 1 illustrates an example of the configuration of an image forming system according to an exemplary embodiment of the invention.

FIG. 1 illustrates an example of the configuration of an image forming system according to an exemplary embodiment of the invention. The image forming system includes, as shown in FIG. 1, an image processing apparatus 1 and an image forming apparatus 2. The image processing apparatus 1 receives image data from a client terminal (not shown), performs image processing on the received image data, and transmits the processed image data to the image forming apparatus 2. The image forming apparatus 2 receives image data from the image processing apparatus 1 and forms images on the basis of the received image data in accordance with an electrophotographic process. The image processing apparatus 1 and the image forming apparatus 2 are connected to each other via a communication line 3, such as a local area network (LAN).

The configurations of the image processing apparatus 1 and the image forming apparatus 2 will be discussed below.

Figure 2:
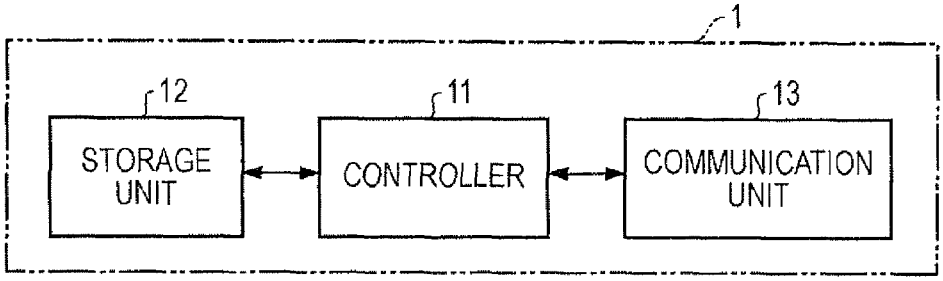
FIG. 2 is a block diagram illustrating an example of the hardware configuration of an image processing apparatus.

FIG. 2 is a block diagram illustrating an example of the hardware configuration of the image processing apparatus 1. The image processing apparatus 1 includes, as shown in FIG. 2, a controller 11, a storage unit 12, and a communication unit 13. The controller 11 includes a central processing unit (CPU), a read only memory (ROM), and a random access memory (RAM). The controller 11 controls individual components of the image processing apparatus 1 as a result of the CPU executing a program stored in the RAM or the storage unit 12. The storage unit 12 is a storage device, such as a hard disk drive (HDD), and stores image data, programs, etc., therein. The communication unit 13 includes an interface card and performs communication with an external apparatus.

Figure 3:
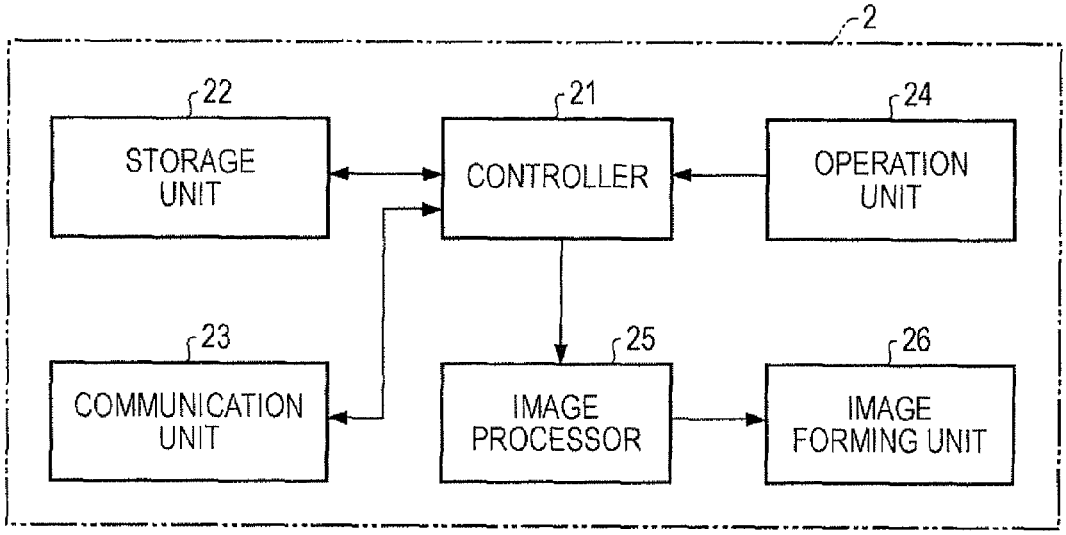
FIG. 3 is a block diagram illustrating an example of the hardware configuration of an image forming apparatus.

FIG. 3 is a block diagram illustrating an example of the hardware configuration of the image forming apparatus 2. The image forming apparatus 2 includes, as shown in FIG. 3, a controller 21, a storage unit 22, a communication unit 23, an operation unit 24, an image processor 25, and an image forming unit 26. The controller 21 includes a CPU, a ROM, and a RAM. The controller 21 controls individual components of the image forming apparatus 2 as a result of the CPU executing a program stored in the RAM or the storage unit 22. The communication unit 23 includes an interface card and performs communication with an external apparatus. The operation unit 24 includes operation keys and a touch panel, and outputs a signal representing the content of an operation performed on the operation keys or the touch panel by the user to the controller 21.

The image processor 25 includes an integrated circuit, such as an application specific integrated circuit (ASIC), and an image memory. The image processor 25 stores image data output from the controller 21 in the image memory, and performs image processing on the image data. The image processor 25 performs, for example, tone correction processing. The image processor 25 may also perform another type of image processing, such as shading correction processing.

The image forming unit 26 forms images on the basis of image data output from the image processor 25 in accordance with an electrophotographic process. The image forming unit 26 forms images on a recording medium by using four colors of toners constituted of yellow (Y), magenta (M), cyan (C), and black (K). The recording medium is recording paper, a plastic sheet, such as an overhead projector (OHP) sheet.

Figure 4:
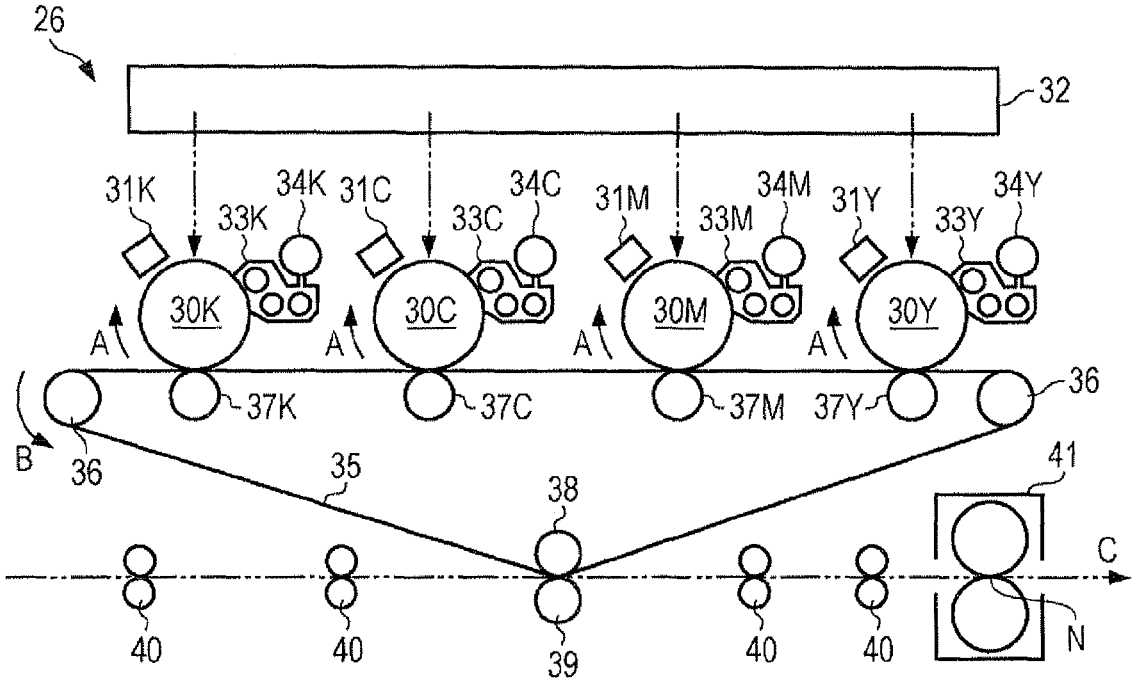
FIG. 4 illustrates an example of the configuration of an image forming unit.

FIG. 4 illustrates an example of the configuration of the image forming unit 26. In FIG. 4, alphabetical characters (Y, M, C, and K) appended to reference numerals refer to associated colors of toners used by components denoted by the corresponding reference numerals. Components having the same reference numeral and different alphabetical characters have the same configuration although the colors of toners used by the components are different. The components having the same configuration are indicated only by a reference numeral while omitting alphabetical characters appended thereto unless it is necessary to distinguish the individual components.

In FIG. 4, a recording medium transported within the image forming unit 26 is fed by a feeder (not shown), and is transported in the direction C indicated by the broken line. While the recording medium is being transported, an image is formed on the surface of the recording medium. The photoconductor drums 30 are cylindrical members each having multilayered photoconductive films on the outer periphery thereof, and are rotatably supported. The photoconductor drums 30 are disposed such that they are in contact with an intermediate transfer belt 35, and are rotated about the centers of the cylindrical members in the direction A indicated by the arrows, in accordance with the movement of the intermediate transfer belt 35. The photoconductor drums 30 are each an example of an "image carrier" according to an exemplary embodiment of the invention.

Charging devices 31 are, for example, scorotron charging devices, and charge the photoconductive films of the associated photoconductor drums 30 at a predetermined potential. The charging devices 31 are each an example of a "charging device" according to an exemplary embodiment of the invention. An exposure device 32 exposes the photoconductor drums 30 charged by the charging devices 31 and forms electrostatic latent images on the photoconductor drums 30 in accordance with exposure light. The exposure device 32 exposes the photoconductor drums 30 to light on the basis of image data output from the controller 21. The exposure device 32 is an example of an "exposure device" according to an exemplary embodiment of the invention.

Developing devices 33 each contain a two component developer composed of one of Y, M, C, and K colors of toners and a magnetic carrier, such as ferrite powder. The developing devices 33 cause toner to adhere to electrostatic latent images formed on the associated photoconductor drums 30, thereby forming toner images. The developing devices 33 are connected to associated toner cartridges 34 via toner supply channels and receive supply of toner from the toner cartridges 34 by the rotation of dispense motors (not shown). The revolutions per minute (RPM) of the dispense motors is controlled by the controller 21 in accordance with an amount of toner to be supplied. The developing devices 33 are each an example of a "developing device" according to an exemplary embodiment of the invention.

The intermediate transfer belt 35 is an endless belt member, and is rotated in the direction B indicated by the arrow in FIG. 4 while being in contact with rotation rollers 36, first transfer rollers 37, and a backup roller 38. The rotation rollers 36 are cylindrical members that support the movement of the intermediate transfer belt 35, and are rotated about the centers of the cylinders. The first transfer rollers 37 are cylindrical members which oppose the associated photoconductor drums 30 with the intermediate transfer belt 35 therebetween. Upon receiving a transfer bias from a power source (not shown), the first transfer rollers 37 each generate a potential difference between the first transfer roller 37 and the associated photoconductor drum 30 so as to transfer a toner image formed on the surface of the photoconductor drum 30 to the surface of the intermediate transfer belt 35. The value of a transfer bias to be applied to each of the first transfer rollers 37 is stored in the RAM for each page, which will be discussed later. The first transfer roller 37 is an example of a "transfer device" according to an exemplary embodiment of the invention.

A second transfer roller 39 is a cylindrical member which opposes the backup roller 38 with the intermediate transfer belt 35 therebetween. Upon receiving a transfer bias from a power source (not shown), the second transfer roller 39 generates a potential difference between the second transfer roller 39 and the backup roller 38 so as to transfer the toner image on the surface of the intermediate transfer belt 35 to a recording medium. The value of a transfer bias to be applied to the second transfer roller 39 is stored in the RAM for each page, which will be discussed later. The second transfer roller 39 is an example of a "transfer device" according to an exemplary embodiment of the invention.

Transport rollers 40 are cylindrical members which are driven by a drive unit (not shown) so as to transport a recording medium in the direction C indicated by the broken line in FIG. 4. The transport rollers 40 are rotated such that a recording medium is transported at a predetermined transport speed.

A fixing device 41 includes a fixing roller and a pressurizing roller. The fixing device 41 performs fixing processing for heating and pressurizing a recording medium on which a toner image is transferred, in a region N sandwiched between the fixing roller and the pressurizing roller, thereby fixing the toner image on the recording medium.

The configuration of the image forming unit 26 has been discussed above.

Figure 5:
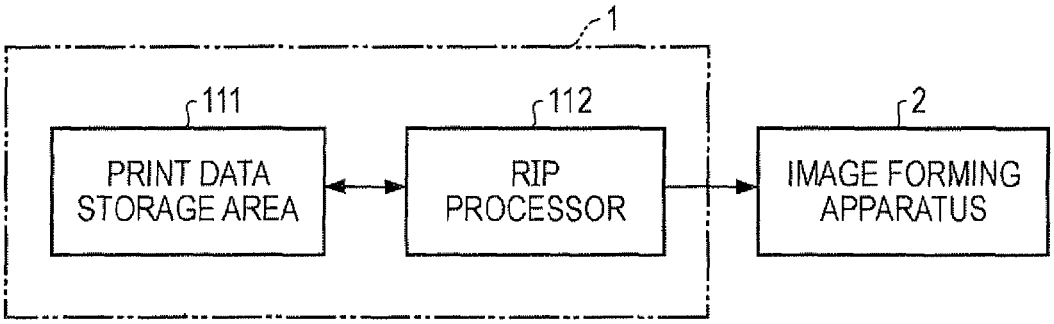
FIG. 5 is a functional block diagram illustrating an example of the functional configuration of the image processing apparatus.

The functional configuration of the image forming system according to this exemplary embodiment will now be described below. FIG. 5 is a functional block diagram illustrating an example of the functional configuration of the image processing apparatus 1. The functional blocks shown in FIG. 5 are implemented as a result of the CPU executing an image processing program stored in the ROM of the controller 11. The image processing program is a program for performing image processing on print data sent from a client terminal.

A print data storage area 111 is an area in which plural items of print data sent from a client terminal and to be subjected to raster image processing (RIP), which will be discussed later, are temporarily and sequentially stored. The print data includes image data described in a page description language (PDL) (hereinafter referred to as "PDL data") and print control information.

A RIP processor 112 reads PDL data among plural items of print data stored in the print data storage area 111 and interprets the read PDL data, thereby generating YMCK raster data (hereinafter referred to as "image data"). The image data generated by the RIP processor 112 is sent to the image forming apparatus 2 via the communication line 3, together with the associated print data ID and page numbers. In a first exemplary embodiment, as the image data, image data representing images included in plural pages is assumed.

The functional configuration of the image processing apparatus 1 has been discussed.

Figure 6:
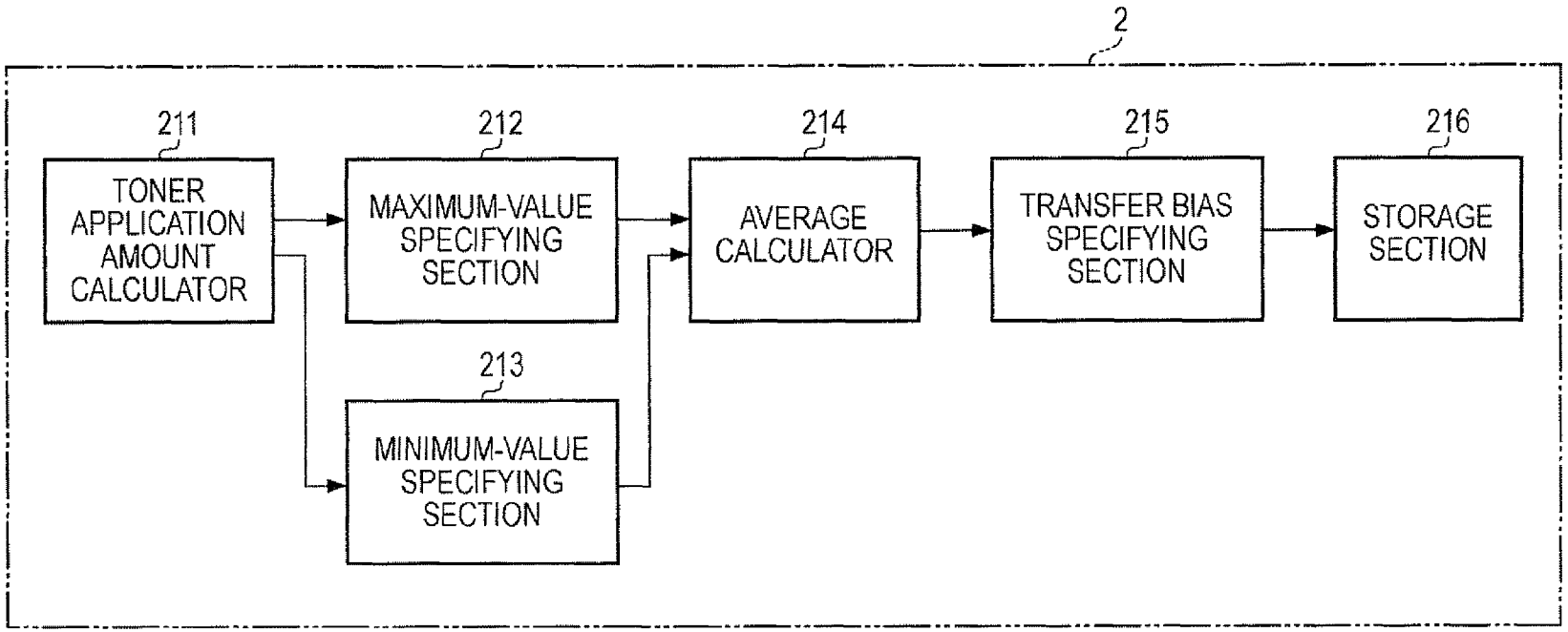
FIG. 6 is a functional block diagram illustrating an example of the functional configuration of the image forming apparatus according to a first exemplary embodiment of the invention.

FIG. 6 is a functional block diagram illustrating an example of the functional configuration of the image forming apparatus 2 according to the first exemplary embodiment. The functional blocks shown in FIG. 6 are implemented as a result of the CPU executing a first transfer bias setting processing program stored in the ROM of the controller 21. The first transfer bias setting processing program is a program for setting the value of a transfer bias to be applied to the first transfer roller 37.

A toner application amount calculator 211 calculates an amount of toner to be applied (hereinafter referred to as a "toner application amount") for each of plural pages forming image data. The toner application amount calculator 211 calculates a toner application amount concerning one of Y, M, C, and K colors. For example, when setting the value of a transfer bias to be applied to the first transfer roller 37Y, an amount of toner of Y color is calculated. The toner application amount is an amount of toner to be transferred to a recording sheet. More specifically, the toner application amount calculator 211 first specifies, for each page, a toner application amount for each pixel, and then, adds toner application amounts specified for individual pixels. In this case, when specifying a toner application amount for each pixel concerning, for example, the Y color, the toner application amount calculator 211 specifies a toner application amount corresponding to a Y signal value by referring to a linear lookup table stored in the storage unit 22. The toner application amount calculator 211 is an example of a "toner application amount specifying unit" according to an exemplary embodiment of the invention.

A maximum-value specifying section 212 specifies a maximum value among toner application amounts calculated by the toner application amount calculator 211. A minimum-value specifying unit 213 specifies a minimum value among toner application amounts calculated by the toner application amount calculator 211. An average calculator 214 calculates an average of the maximum value specified by the maximum-value specifying section 212 and the minimum value specified by the minimum-value specifying section 213. A transfer bias specifying section 215 specifies the value of a transfer bias to be applied to the first transfer roller 37 on the basis of the average value calculated by the average calculator 214. More specifically, the transfer bias specifying section 215 specifies a transfer bias value associated with the average value calculated by the average calculator 214 by referring to the linear lookup table stored in the storage unit 22. The transfer bias specifying section 215 is an example of a "controller" according to an exemplary embodiment of the invention. A storage section 216 stores in the RAM a transfer bias value specified for each page by the transfer bias specifying section 215. More specifically, the storage section 216 stores information concerning the association between transfer bias values and pages in the RAM in a table format, as that shown in FIG. 7.

The functional configuration of the image forming apparatus 2 has been discussed above.

1-2. Operation

A description will be given below of first transfer bias setting processing executed in the image forming apparatus 2 according to the first exemplary embodiment. This processing is performed by the CPU executing the associated program stored in the ROM of the image forming apparatus 2. This processing may be performed for each of the first transfer rollers 37. In the following description, it is assumed that the value of a transfer bias to be applied to the first transfer roller 37Y is set.

Figures 7, 8:
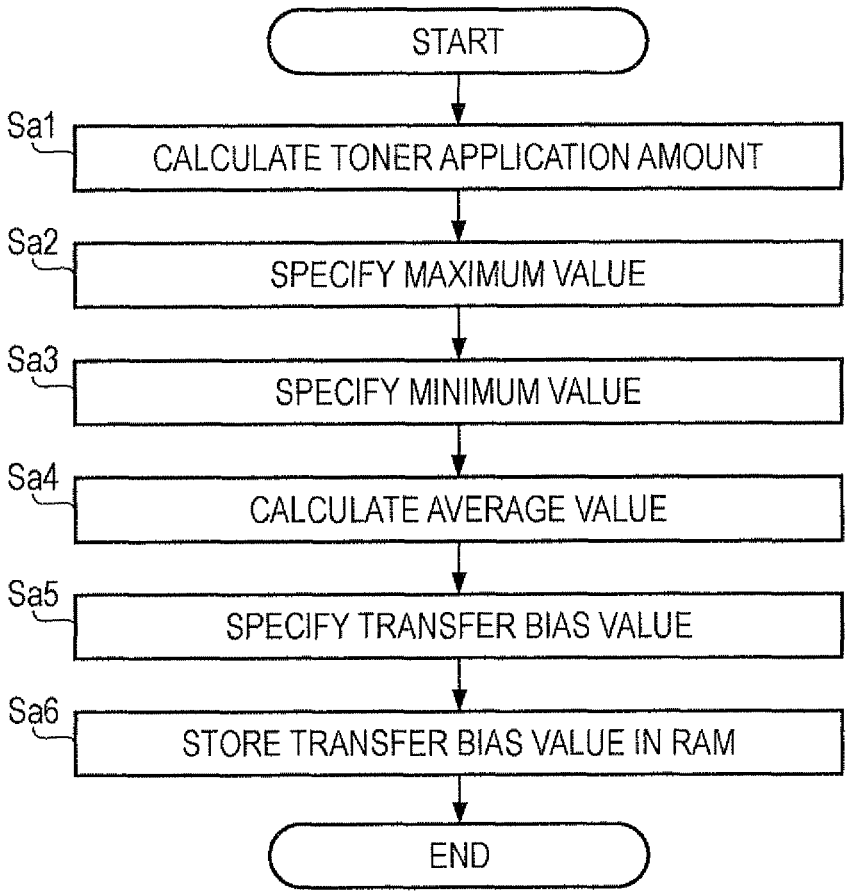
FIG. 7 illustrates an example of the storage content of a random access memory (RAM)
FIG. 8 is a flowchart illustrating first transfer bias setting processing according to the first exemplary embodiment of the invention.

FIG. 8 is a flowchart illustrating first transfer bias setting processing. This processing is performed in order to set the value of a transfer bias to be applied to the first transfer roller 37Y. In step Sa1, the controller 21 of the image forming apparatus 2 calculates a Y toner application amount for each of plural pages forming image data. More specifically, the controller 21 specifies, for each page, a Y toner application amount for each pixel by referring to the linear lookup table stored in the storage unit 22, and then, adds Y toner application amounts specified for individual pixels.

Then, in step Sa2, the controller 21 specifies a maximum value among the toner application amounts calculated for individual pages. Then, in step Sa3, the controller 21 specifies a minimum value among the toner application amounts calculated for individual pages. In step Sa4, the controller 21 calculates the average of the specified maximum value and minimum value. Then, in step Sa5, the controller 21 specifies the value of a transfer bias to be applied to the first transfer roller 37Y. More specifically, the controller 21 specifies a transfer bias value associated with the calculated average by referring to the linear lookup table stored in the storage unit 22. Then, in step Sa6, the controller 21 stores in the RAM the transfer bias value specified for each page.

The first transfer bias setting processing has been discussed above.

In the above-described first exemplary embodiment, concerning image data representing images of plural pages, toner application amounts for individual pages are calculated, and the average of the maximum value and the minimum value of the toner application amounts is calculated. Then, the transfer bias value is specified from the calculated average, and the specified transfer bias value is applied to all the pages. In contrast, if, concerning image data representing images of plural pages, a transfer bias value is set for each page in accordance with the associated toner application amount, the optimal transfer bias value can be set for each page. However, if a logo mark is contained in all pages, the color tone or shade of the logo mark may become different depending on the page, since the transfer bias value is set for each page. In the first exemplary embodiment, however, the same transfer bias value is set for all pages, and even if a logo mark is contained in all the pages, a variation in the color tone or shade of the logo mark among the pages is suppressed.

2. Second Exemplary Embodiment

In the above-described first exemplary embodiment, the same transfer bias value is set for all pages regardless of the content of image data. Alternatively, depending on the content of image data, the same transfer bias value may be set only for pages that satisfy predetermined conditions. For example, among plural pages including images represented by image data, the same transfer bias value may be set only for pages including images having a similarity which is equal to or greater than a predetermined threshold. This will be discussed in detail below in a second exemplary embodiment.

2-1. Configuration

The overall configuration of an image forming system according to the second exemplary embodiment is the same as that of the first exemplary embodiment. Accordingly, an explanation of the overall configuration of the image forming system will be omitted. The hardware configuration of the image processing apparatus 1 and that of the image forming apparatus 2 according to the second exemplary embodiment are also the same as those of the first exemplary embodiment. Accordingly, an explanation of the hardware configurations of the image processing apparatus 1 and the image forming apparatus 2 will also be omitted. The functional configuration of the image forming system according to the second exemplary embodiment will be described below.

Figure 9:
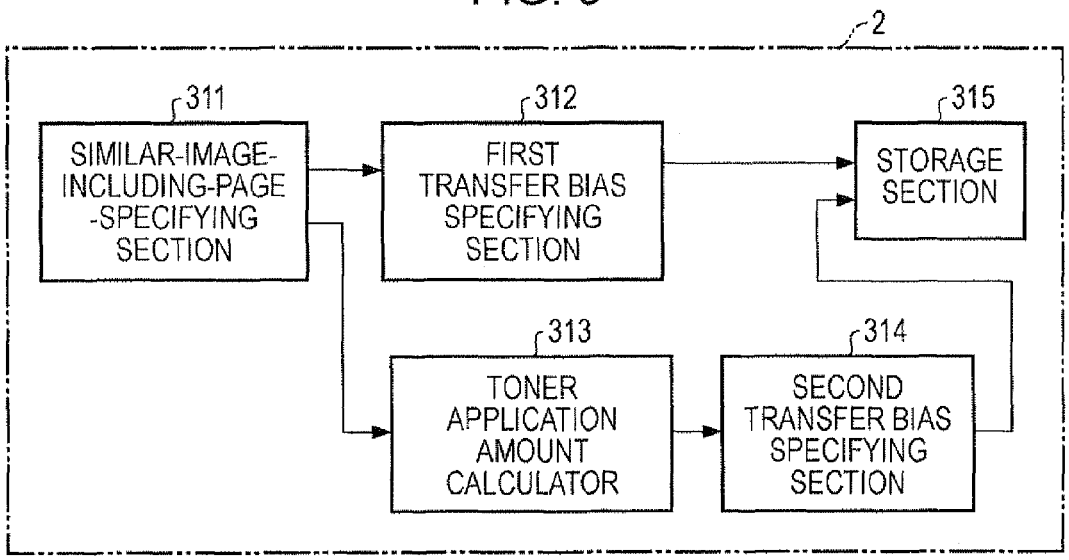
FIG. 9 is a functional block diagram illustrating an example of the functional configuration of the image forming apparatus according to a second exemplary embodiment of the invention.

The functional configuration of the image processing apparatus 1 is the same as that of the first exemplary embodiment, and thus, an explanation thereof will be omitted. FIG. 9 is a functional block diagram illustrating an example of the functional configuration of the image forming apparatus 2 according to the second exemplary embodiment. The functional blocks shown in FIG. 9 are implemented as a result of the CPU executing a first transfer bias setting processing program stored in the ROM of the controller 21. The first transfer bias setting processing program is a program for setting the value of a transfer bias to be applied to the first transfer roller 37.

A similar-image-including-page-specifying section 311 specifies, concerning image data representing images included in plural pages, among such plural pages, pages including images having a similarity which is equal to or greater than a predetermined threshold. As an approach to specifying pages including similar images, a known technique may be utilized. For example, the similar-image-including-page-specifying section 311 may calculate a toner application amount of each of the Y, M, C, and K colors, in a predetermined region of each page, and determine as a condition whether the difference in the toner application amount of each color among individual pages is within a predetermined range. Then, the similar-image-including-page-specifying section 311 may determine that pages that satisfy the above-described condition are pages including similar images.

For example, assume that, in a predetermined region of one page, the toner application amounts of Y, M, C, and K colors are 20 mg, 6 mg, 10 mg, and 0 mg, respectively, and, in a predetermined region of another page, the toner application amounts of Y, M, C, and K colors are 19 mg, 5 mg, 9 mg, and 0 mg, respectively. In this case, if the predetermined threshold is "2", the differences in the toner application amount of the individual colors between the two pages are all within "2". Thus, the two pages are specified as pages including similar images.

The predetermined region of a page in which the toner application amount is to be calculated may be the top 3-cm region of a A4 size sheet when the longitudinal side of the sheet is horizontally placed. A method for calculating Y, M, C, and K toner application amounts for each page may be as follows, as in the first exemplary embodiment. A toner application amount for each pixel may be first specified by referring to the linear lookup table stored in the storage unit 22, and then, the toner application amounts specified for the individual pixels may be added. The similar-image-including-page-specifying section 311 is an example of a "page specifying unit" according to an exemplary embodiment of the invention.

A first transfer bias specifying section 312 specifies a transfer bias value for pages that have been specified as pages including similar images by the similar-image-including-page-specifying section 311. More specifically, the first transfer bias specifying section 312 specifies a transfer bias value stored in the storage unit 22 as the transfer bias value applied to all of such pages. The first transfer bias specifying section 312 is an example of a "controller" according to an exemplary embodiment of the invention.

A toner application amount calculator 313 calculates a toner application amount for each of pages that have not been specified as pages including similar images. The toner application amount calculator 313 calculates toner application amounts for one of Y, M, C, and K colors. For example, when setting the value of a transfer bias to be applied to the first transfer roller 37Y, the toner application amount calculator 313 calculates toner application amounts for the Y color. An approach to calculating toner application amounts is the same as that of the first exemplary embodiment.

A second transfer bias specifying section 314 specifies a transfer bias value for each page associated with the toner application amount calculated by the toner application amount calculator 313 by referring to the linear lookup table stored in the storage unit 22. A storage section 315 stores in the RAM information concerning the association between transfer bias values specified by the first and second transfer bias specifying sections 312 and 314 and pages, in a table format as that shown in FIG. 7.

The functional configuration of the image forming apparatus 2 has been discussed above.

2-2. Operation

A description will now be given of first transfer bias setting processing performed in the image forming apparatus 2 of the second exemplary embodiment. This processing is performed as a result of the CPU executing the associated program stored in the ROM of the image forming apparatus 2. This processing may be performed for each of the first transfer rollers 37. In the following description, it is assumed that the value of a transfer bias to be applied to the first transfer roller 37Y is set.

Figure 10:
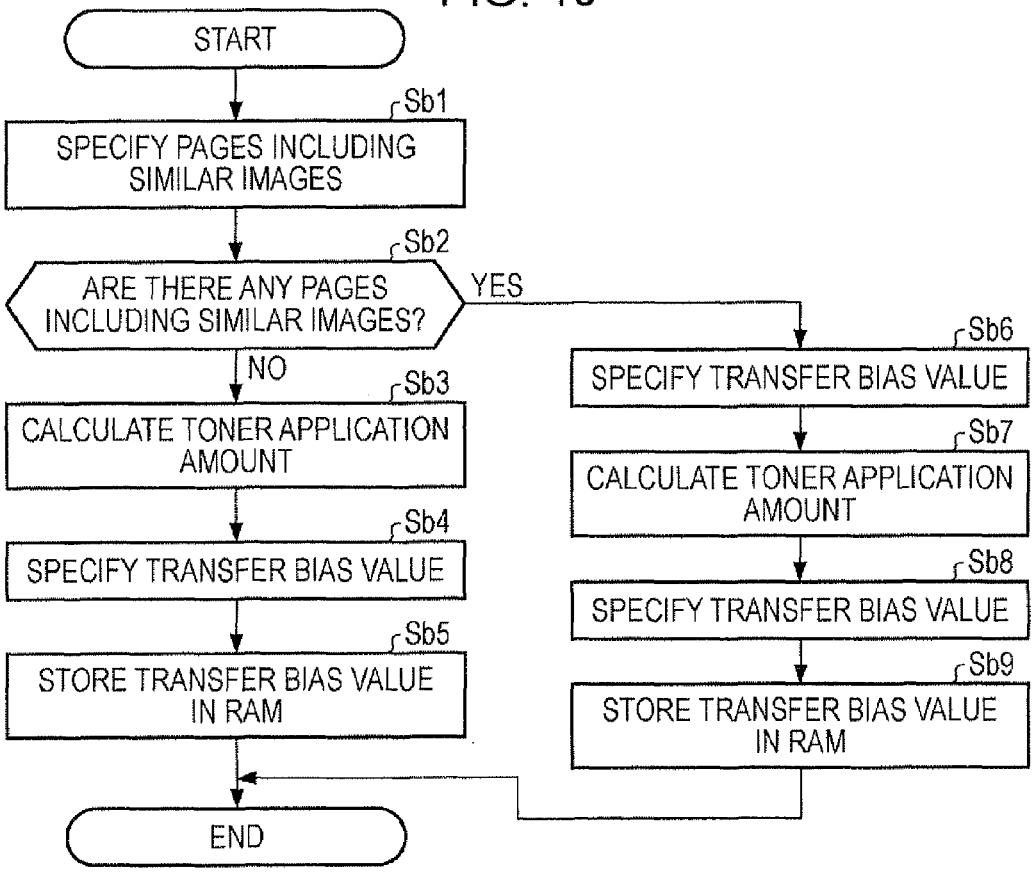
FIG. 10 is a flowchart illustrating first transfer bias setting processing according to the second exemplary embodiment of the invention.

FIG. 10 is a flowchart illustrating the first transfer bias setting processing. This processing is performed in order to set the value of a transfer bias to be applied to the first transfer roller 37Y. In step Sb1, the controller 21 of the image forming apparatus 2 specifies, concerning image data representing images included in plural pages, among such plural pages, pages including images having a similarity which is equal to or greater than a predetermined threshold. For example, the controller 21 may calculate Y, M, C, and K toner application amounts, in a predetermined region of each page, and determine as a condition whether the difference in the toner application amount of each color among individual pages is within a predetermined range. Then, the controller 21 may determine that pages that satisfy the above-described condition are pages including similar images.

Then, in step Sb2, the controller 21 determines whether there are any pages that have been specified as pages including similar pages. If it is determined in step Sb2 that such pages are not included (if the result of step Sb2 is NO), the controller 21 executes step Sb3. In contrast, if it is determined in step Sb2 that such pages are included (if the result of step Sb2 is YES), the controller 21 executes step Sb6.

In step Sb3, the controller 21 calculates a Y toner application amount for each page. More specifically, the controller 21 first specifies a Y toner application amount for each pixel by referring to the linear lookup table stored in the storage unit 22, and then, adds the toner application amounts for the individual pixels. Then, in step Sb4, the controller 21 specifies, for each page, the value of a transfer bias to be applied to the first transfer roller 37Y, on the basis of the calculated toner application amount. More specifically, the controller 21 specifies a transfer bias value corresponding to the calculated average by referring to the linear lookup table stored in the storage unit 22. In step Sb5, the controller 21 then stores, for each page, the specified transfer bias value in the RAM.

In step Sb6, the controller 21 specifies a transfer bias value for pages that have been specified as pages including similar pages in step Sb1. More specifically, the controller 21 specifies a transfer bias value stored in the storage unit 22 as the transfer bias value to be applied to all of such pages. Then, in step Sb7, the controller 21 calculates a toner application amount for each of the pages that have not been specified as pages including similar images in step Sb1. More specifically, the controller 21 first specifies, for each of such pages, a Y toner application amount for each pixel by referring to the linear lookup table stored in the storage unit 22, and then, adds the toner application amounts specified for individual pixels.

Then, in step Sb8, the controller 21 specifies a transfer bias value for each page for which the toner application amount has been calculated in step Sb7. More specifically, the controller 21 specifies, for each page, a transfer bias value associated with the calculated toner application amount by referring to the linear lookup table stored in the storage unit 22. In step Sb9, the controller 21 then stores, for each page, in the RAM the transfer bias values specified in step Sb6 and step Sb8.

The first transfer bias setting processing has been discussed above.

In the above-described second exemplary embodiment, concerning image data representing images of plural pages, among such plural pages, pages including similar images are specified, and then, the same transfer bias value is set for the specified pages. In contrast, if, concerning image data representing images of plural pages, the value of a transfer bias is set for each page in accordance with the associated toner application amount, the optimal transfer bias value can be set for each page. However, if a logo mark is contained in all pages, the color tone or shade of the logo mark may become different depending on the page, since the transfer bias value is set for each page. In the second exemplary embodiment, however, if a logo mark is contained in some pages, the same transfer bias value used for such pages is set, and even if a logo mark is contained in some pages, a variation in the color tone or shade of the logo mark among the pages is suppressed.

3. Modified Examples

The above-described exemplary embodiments may be modified as follows. Additionally, the following modified examples may be combined.

3-1. First Modified Example

Figure 11:
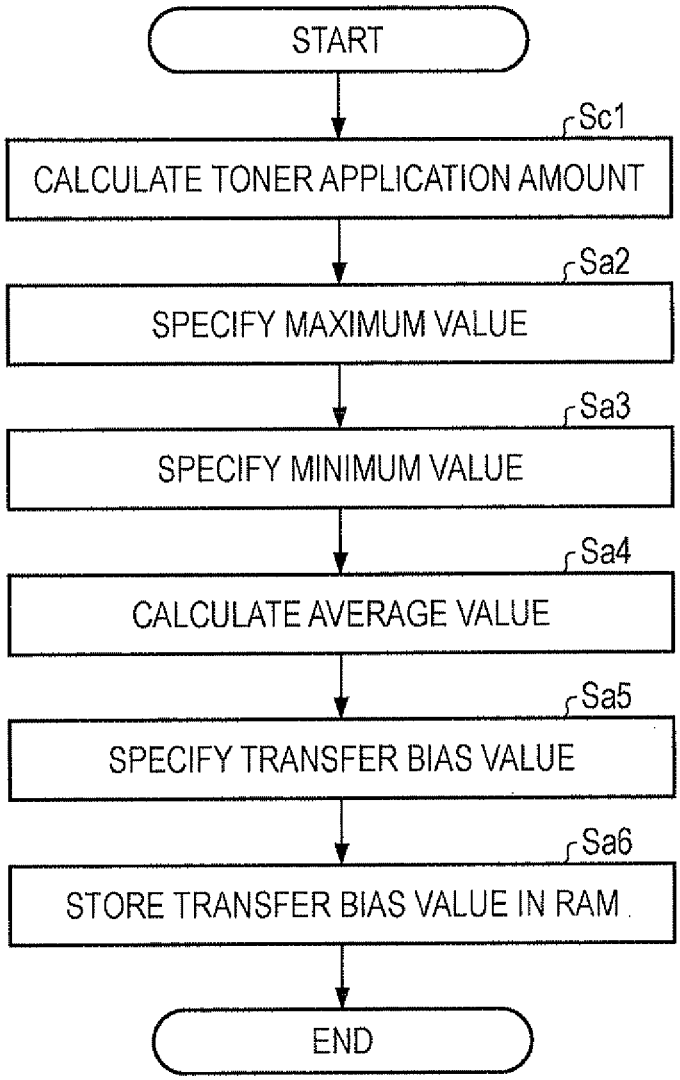
FIG. 11 is a flowchart illustrating second transfer bias setting processing according to a first modified example.

In the first exemplary embodiment, the value of a transfer bias to be applied to the first transfer roller 37 is set. Alternatively, instead of the first transfer roller 37, the value of a transfer bias to be applied to the second transfer roller 39 may be set. FIG. 11 is a flowchart illustrating second transfer bias setting processing according to a first modified example. In FIG. 11, the same processing operations as those in FIG. 8 are designated by like step numbers, and an explanation thereof will thus be omitted.

In the first modified example, in step Sc1, the controller 21 of the image forming apparatus 2 calculates, concerning image data representing images of plural pages, a toner application amount for each page. In the first modified example, however, unlike the first exemplary embodiment, the controller 21 calculates toner application amounts for all the four Y, M, C, and K colors. More specifically, as in the first exemplary embodiment, the controller 21 first specifies, concerning each color, a toner application amount for each pixel by referring to the linear lookup table stored in the storage unit 22, and then, adds toner application amounts specified for individual pixels. Then, the controller 21 adds toner application amounts calculated for individual colors, thereby calculating a toner application amount for each page. Steps Sa2 through Sa6 are the same as those of the first exemplary embodiment.

3-2. Second Modified Example

Figure 12:
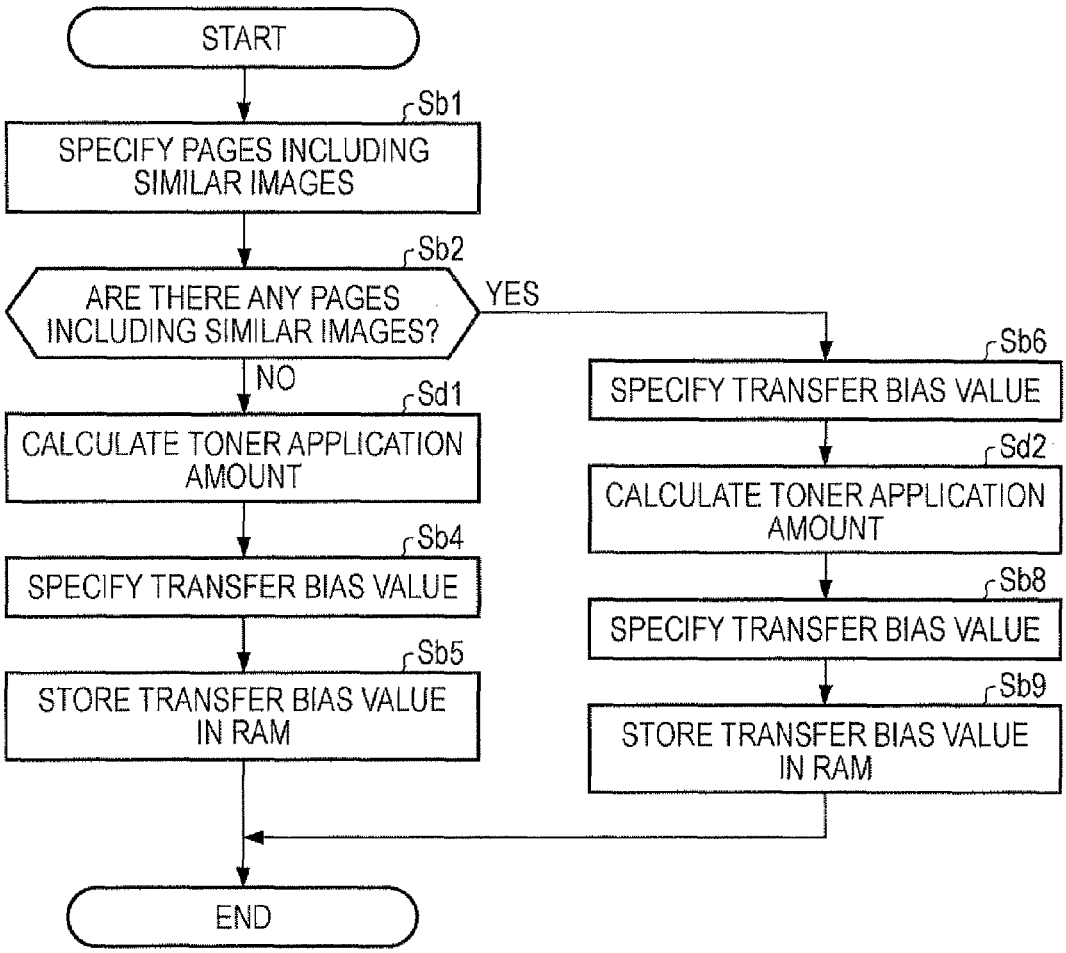
FIG. 12 is a flowchart illustrating second transfer bias setting processing according to a second modified example.

In the second exemplary embodiment, the value of a transfer bias to be applied to the first transfer roller 37 is set. Alternatively, instead of the first transfer roller 37, the value of a transfer bias to be applied to the second transfer roller 39 may be set. FIG. 12 is a flowchart illustrating second transfer bias setting processing according to a second modified example. In FIG. 12, the same processing operations as those in FIG. 10 are designated by like step numbers, and an explanation thereof will thus be omitted.

In the second modified example, in step Sd1, the controller 21 of the image forming apparatus 2 calculates a toner application amount for each page. In the second modified example, however, unlike the second exemplary embodiment, the controller 21 calculates toner application amounts for all the four Y, M, C, and K colors. More specifically, as in the second exemplary embodiment, the controller 21 first specifies, concerning each color, a toner application amount for each pixel by referring to the linear lookup table stored in the storage unit 22, and then, adds toner application amounts specified for individual pixels. Then, the controller 21 adds toner application amounts calculated for individual colors, thereby calculating a toner application amount for each page.

In step Sd2, the controller 21 calculates, concerning pages that have not been specified as pages including similar images, toner application amounts for the four Y, M, C, and K colors, as in step Sd1. The other steps are the same as those of the second exemplary embodiment.

3-3. Third Modified Example

Figure 13:
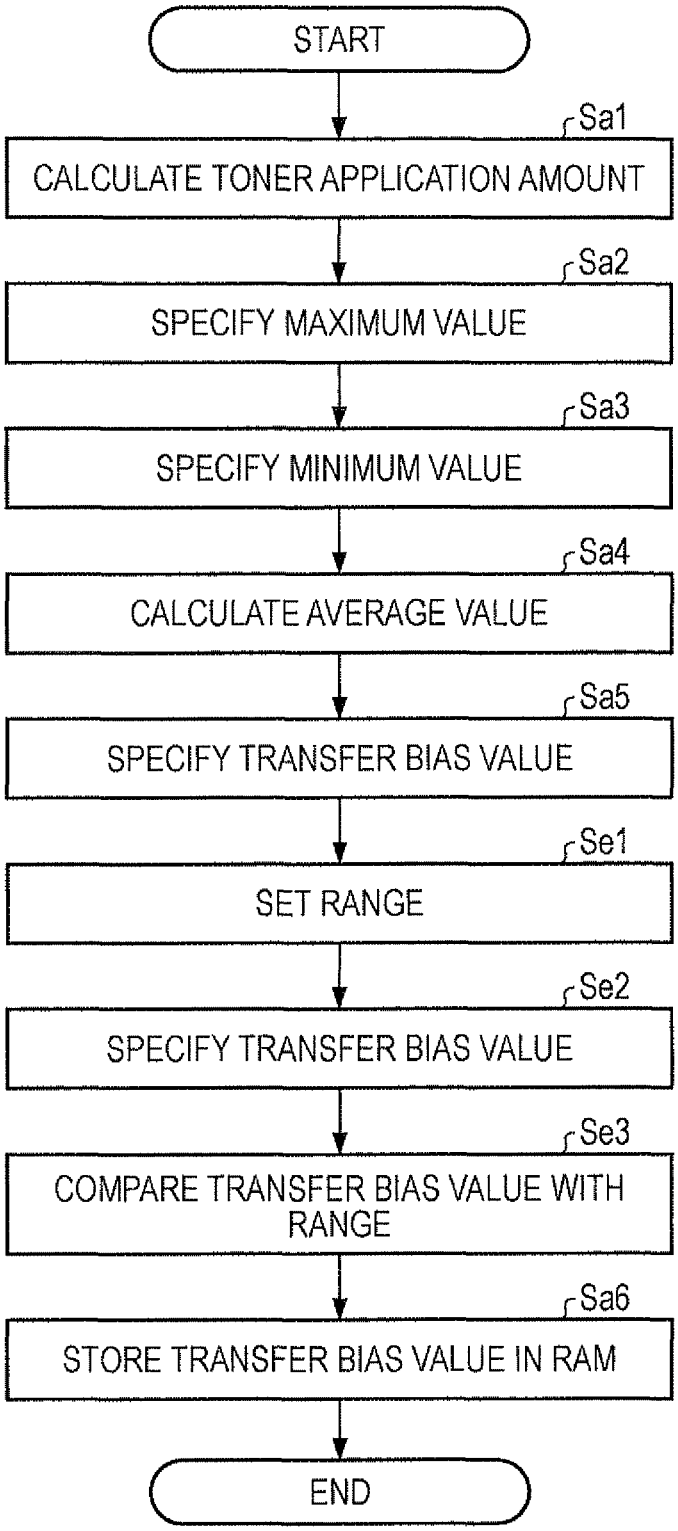
FIG. 13 is a flowchart illustrating first transfer bias setting processing according to a third modified example.

In the first exemplary embodiment, the same transfer bias value is set for all pages. However, it is not always necessary that the same transfer bias value be set for all pages, and, for example, different transfer bias values may be set for individual pages such that they are within a predetermined range. FIG. 13 is a flowchart illustrating first transfer bias setting processing according to a third modified example. In FIG. 13, the same processing operations as those in FIG. 8 are designated by like step numbers, and an explanation thereof will thus be omitted.

In the third modified example, in step Sa5, the controller 21 of the image forming apparatus 2 specifies a transfer bias value associated with the calculated average value. Then, in step Se1, the controller 21 sets a range around the specified transfer bias value. For example, if the specified transfer bias value is ±2 V, the controller 21 sets a range of ±5 V. Then, in step Se2, the controller 21 specifies a transfer bias value for each page on the basis of the toner application amount specified in step Sa1. More specifically, the controller 21 specifies, for each page, a transfer bias value associated with the calculated toner application amount by referring to the linear lookup table stored in the storage unit 22.

In step Se3, the controller 21 then compares the transfer bias value specified for each page with the range set in step Se1, and specifies a transfer bias value for the corresponding page on the basis of the comparison result. More specifically, the controller 21 compares a transfer bias value for each page with each of a higher threshold and a lower threshold, which define the set range. If the transfer bias value is greater than the higher threshold, the controller 21 sets the higher threshold as the transfer bias value. If the transfer bias value is smaller than the lower threshold, the controller 21 sets the lower threshold as the transfer bias value. If the transfer bias value ranges from the lower threshold to the higher threshold, the controller 21 determines the transfer bias value specified in step Se2 as the transfer bias value. In step Sa6, the controller 21 stores, for each page, the specified transfer bias value in the RAM.

3-4. Fourth Modified Example

Figure 14:
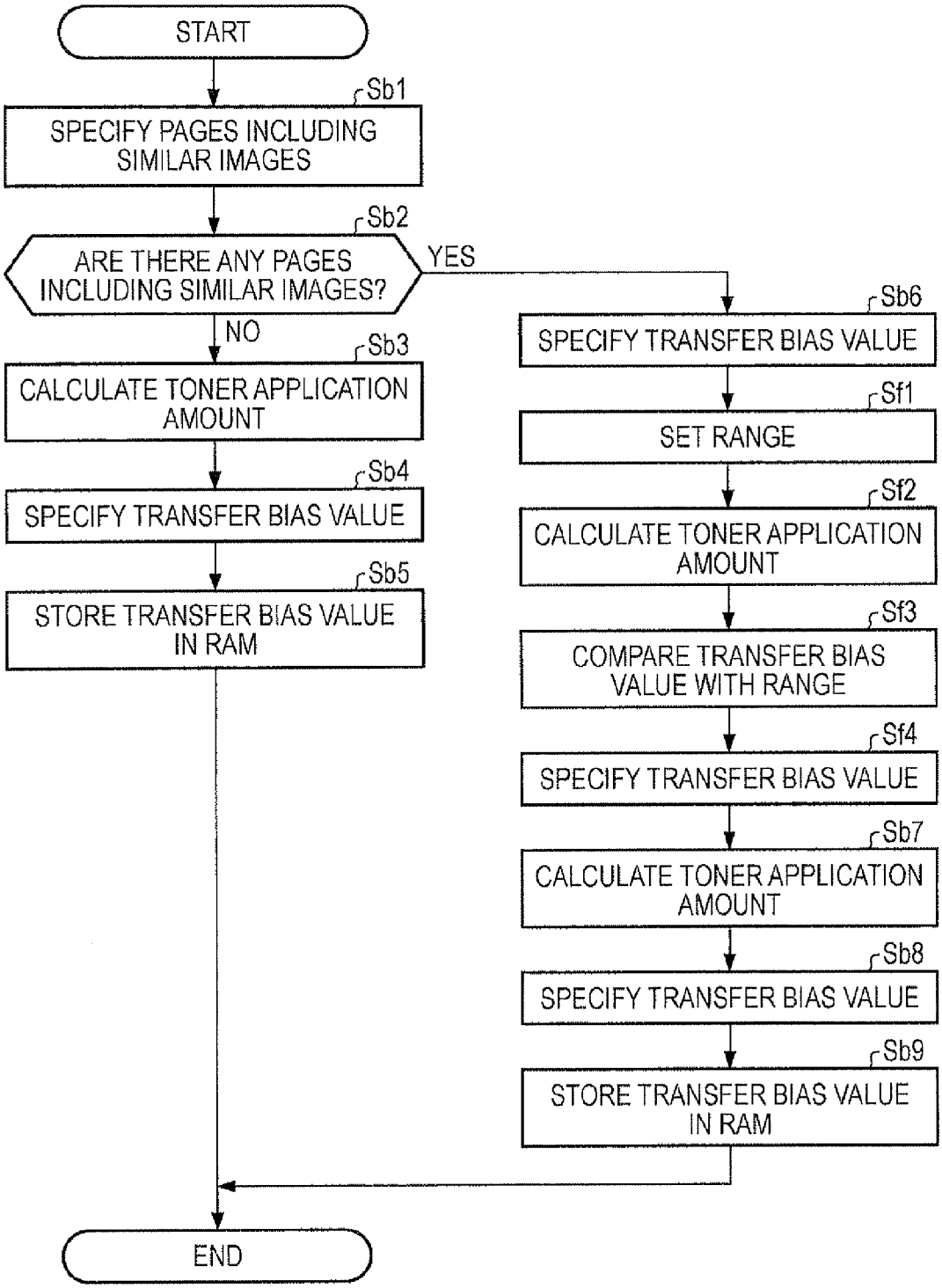
FIG. 14 is a flowchart illustrating first transfer bias setting processing according to a fourth modified example.

In the second exemplary embodiment, the same transfer bias value is set for pages including similar pages. However, as in the third modified example, different transfer bias values may be set for individual pages such that they are within a predetermined range. FIG. 14 is a flowchart illustrating first transfer bias setting processing according to a fourth modified example. In FIG. 14, the same processing operations as those in FIG. 10 are designated by like step numbers, and an explanation thereof will thus be omitted.

In the fourth modified example, if there are pages including similar images (if the result of step Sb2 is YES), a transfer bias value is specified for those pages in step Sb6. Then, in step Sf1, the controller 21 specifies a range around the transfer bias value. In step Sf2, the controller 21 calculates a toner application amount for each of the pages that have been specified as pages including similar pages. More specifically, the controller 21 first specifies, for each page, a Y toner application amount for each pixel by referring to the linear lookup table stored in the storage unit 22, and then adds toner application amounts specified for individual pixels.

Then, in step Sf3, the controller 21 specifies a transfer bias value for each page on the basis of the specified toner application amount. More specifically, the controller 21 specifies, for each page, a transfer bias value associated with the calculated toner application amount by referring to the linear lookup table stored in the storage unit 22. In step Sf4, the controller 21 then compares the transfer bias value specified for each page with the range set in step Sf1, and specifies a transfer bias value for the corresponding page on the basis of the comparison result.

More specifically, the controller 21 compares a transfer bias value for each page with each of the higher threshold and the lower threshold, which define the set range. If the transfer bias value is greater than the higher threshold, the controller 21 specifies the higher threshold as the transfer bias value. If the transfer bias value is smaller than the lower threshold, the controller 21 specifies the lower threshold as the transfer bias value. If the transfer bias value ranges from the lower threshold to the higher threshold, the controller 21 determines the transfer bias value specified in step Sf3 as the transfer bias value. Steps Sb7 through Sb9 are the same as those of the second exemplary embodiment.

3-5. Fifth Modified Example

Figure 15:
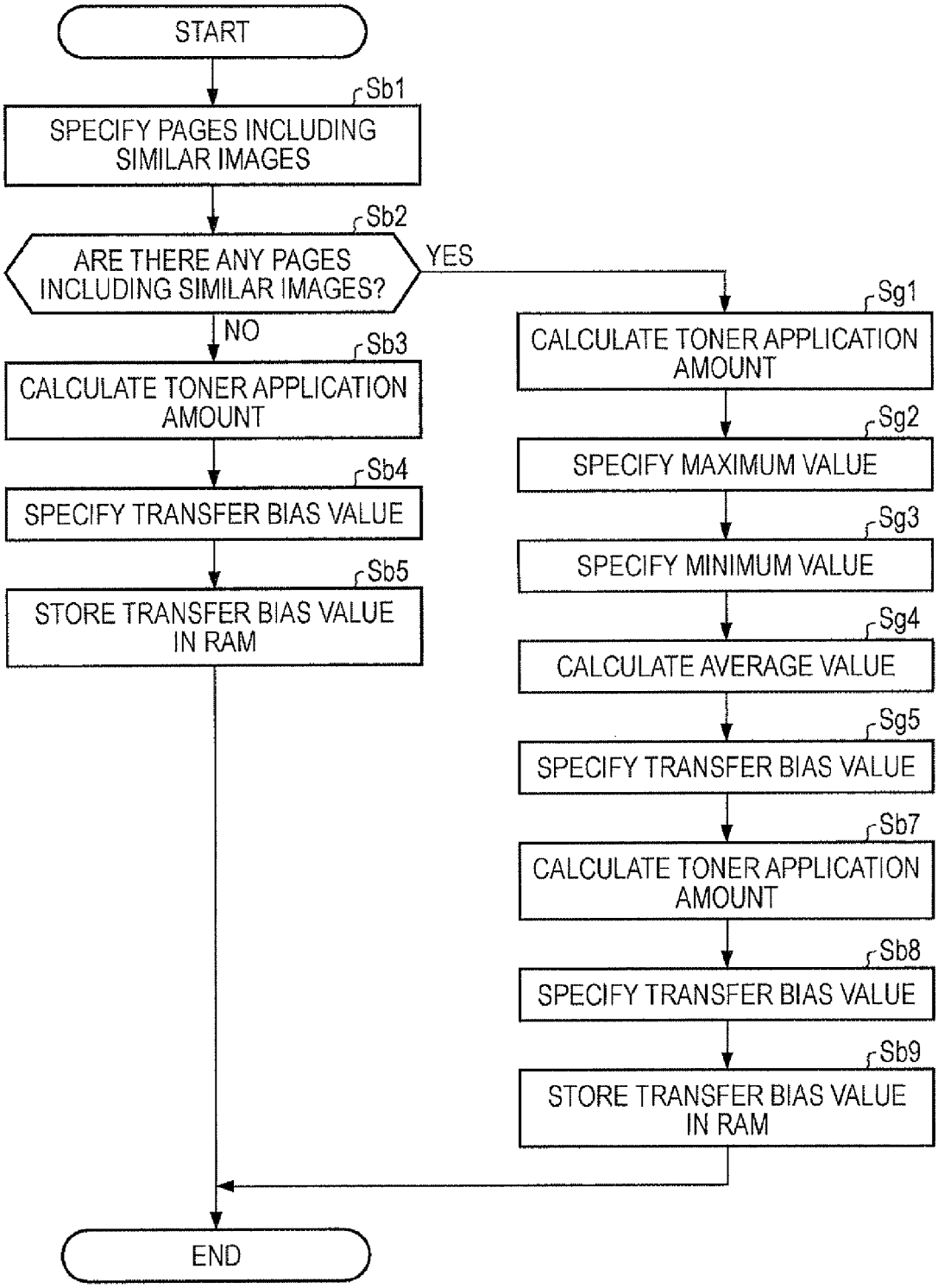
FIG. 15 is a flowchart illustrating first transfer bias setting processing according to a fifth modified example.

In the second exemplary embodiment, the same transfer bias value stored in the storage unit 22 is set for pages including similar images. However, as in the first exemplary embodiment, the transfer bias value set for such pages may be specified from the average of the maximum value and the minimum value of toner application amounts. FIG. 15 is a flowchart illustrating first transfer bias setting processing according to a fifth modified example. In FIG. 15, the same processing operations as those in FIG. 10 are designated by like step numbers, and an explanation thereof will thus be omitted.

In the fifth modified example, if there are pages including similar images (if the result of step Sb2 is YES), in step Sg1, the controller 21 of the image forming apparatus 2 calculates a Y toner application amount for each of such pages. More specifically, the controller 21 first specifies, for each of such pages, a Y toner application amount for each pixel by referring to the linear lookup table stored in the storage unit 22, and then, adds toner application amounts specified for individual pixels. Then, in step Sg2, the controller 21 specifies the maximum value of the calculated toner application amounts for the individual pages. In step Sg3, the controller 21 specifies the minimum value of the calculated toner application amounts for the individual pages.

In step Sg4, the controller 21 calculates the average of the specified maximum value and minimum value. In step Sg5, the controller 21 specifies the value of a transfer bias to be applied to the first transfer roller 37Y on the basis of the calculated average. More specifically, the controller 21 specifies a transfer bias value associated with the calculated average value by referring to the linear lookup table stored in the storage unit 22. Steps Sb7 through Sb9 are the same as those of the second exemplary embodiment.

In the fifth modified example, if, among plural pages, a set of plural pages including first similar images and another set of plural pages including second similar images, which are different from the first images, are included, the maximum value and the minimum value of toner application amounts are specified for each set of the plural pages, and then, the transfer bias value is set on the basis of the average of the maximum value and the minimum value.

3-6. Sixth Modified Example

Figure 16:
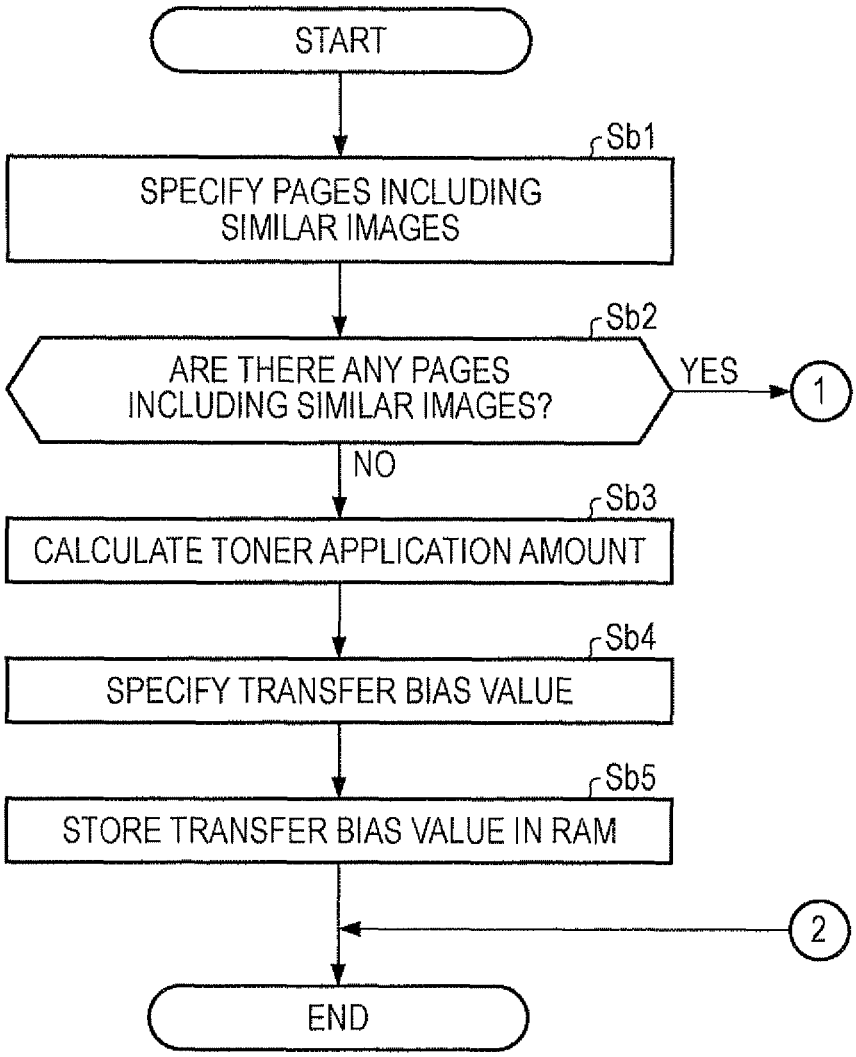
FIGS. 16 and 17 are flowcharts illustrating first transfer bias setting processing according to a sixth modified example.
Figure 17:
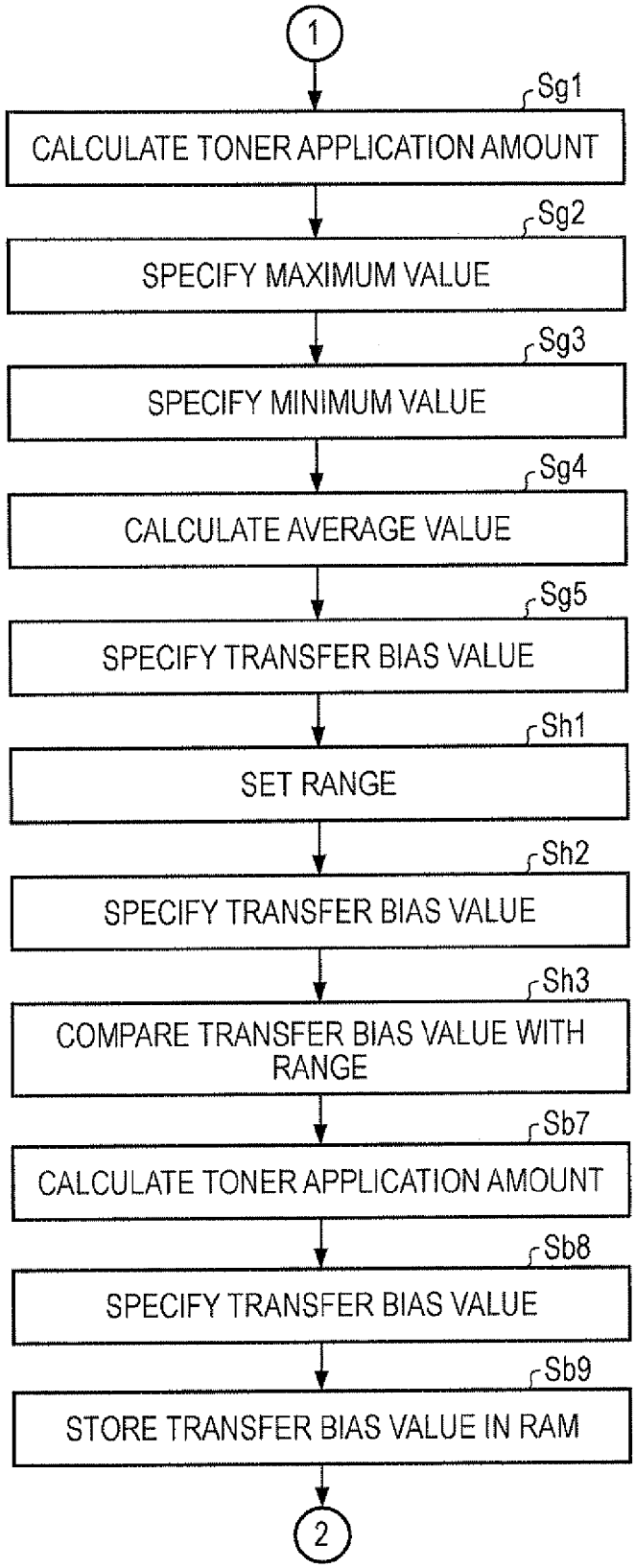

In the fifth modified example, instead of setting the same transfer bias value for pages including similar images, a transfer bias value for each page may be set within a predetermined range, as in the third modified example. FIGS. 16 and 17 are flowcharts illustrating first transfer bias setting processing according to a sixth modified example. In FIGS. 16 and 17, the same processing operations as those in FIG. 15 are designated by like step numbers, and an explanation thereof will thus be omitted.

In FIG. 17, in step Sg5, the controller 21 of the image forming apparatus 2 specifies the value of a transfer bias for pages that have been specified as pages including similar images. Then, in step Sh1, the controller 21 sets a range around the specified transfer bias. Then, in step Sh2, the controller 21 specifies a transfer bias value for each of such pages on the basis of the toner application amount specified in step Sg1. More specifically, the controller 21 specifies, for each of such pages, a transfer bias value associated with the calculated toner application amount by referring to the linear lookup table stored in the storage unit 22.

Then, in step Sh3, the controller 21 compares a transfer bias value specified for each page with the range set in step Sh1, and specifies a transfer bias value for the corresponding page on the basis of the comparison result. More specifically, the controller 21 compares a transfer bias value for each page with each of a higher threshold and a lower threshold, which define the set range. If the transfer bias value is greater than the higher threshold, the controller 21 sets the higher threshold as the transfer bias value. If the transfer bias value is smaller than the lower threshold, the controller 21 sets the lower threshold as the transfer bias value. If the transfer bias value ranges from the lower threshold to the higher threshold, the controller 21 determines the transfer bias value specified in step Sh2 as the transfer bias value. Steps Sb7 through Sb9 are the same as those of the second exemplary embodiment.

3-7. Seventh Modified Example

In the first and second exemplary embodiments, the image forming apparatus 2 may include plural execution modes for selecting the type of first transfer bias setting processing. For example, the image forming apparatus 2 may include a "normal mode" and a "continuity priority mode". More specifically, in the "normal mode", as in the related art, in the image forming apparatus 2, the optimal transfer bias value is set for each page on the basis of a toner application amount. In the "continuity priority mode", in consideration of the continuity of the color tone or shade among pages, the allowance of a variation in the transfer bias value among pages is set within a predetermined value. The execution mode may be selected by a user through the operation unit 24.

In the first exemplary embodiment, if the "normal mode" is selected, the controller 21 specifies and sets a transfer bias value for each page on the basis of a toner application amount calculated for the corresponding page; as in steps Sb3 through Sb5 of the second exemplary embodiment. In contrast, if the "continuity priority mode" is set, the controller 21 specifies and sets a transfer bias value from the average of the maximum value and the minimum value of toner application amounts calculated for individual pages, as in steps Sa1 through Sa6 of the first exemplary embodiment.

In the second exemplary embodiment, if the "normal mode" is selected, the controller 21 executes steps Sb3 through Sb5 without executing steps Sb1 and Sb2. In contrast, if the "continuity priority mode" is set, the controller 21 executes Sb1 through Sb9 of the second exemplary embodiment.

3-8. Eighth Modified Example

In the second exemplary embodiment, in order to specify pages including similar images, the controller 21 of the image forming apparatus 2 may accumulate differences between pixel values of pixels within a predetermined range of each page. Then, the controller 21 may determine as a condition whether the accumulated difference of each page is smaller than a predetermined threshold. As a result of this determination, the controller 21 may specify pages that satisfy this condition as pages including similar images.

3-9. Ninth Modified Example

The programs executed by the CPU of the image forming apparatus 2 in the first and second exemplary embodiments and the modified examples may be provided as a result of being stored in a storage medium, such as magnetic tape, a magnetic disk, a flexible disk, an optical disc, a magneto-optical disk, or a memory, and may be installed in the image forming apparatus 2. The programs may be downloaded into the image forming apparatus 2 via a communication line, such as the Internet.

The foregoing description of the exemplary embodiments and modified examples of the present invention has been provided for the purposes of illustration and description. It is not intended to be exhaustive or to limit the invention to the precise forms disclosed. Obviously, many modifications and variations will be apparent to practitioners skilled in the art. The embodiments and modified examples were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A control apparatus comprising:

a page specifying unit that specifies, concerning image data representing images included in a plurality of pages, among the plurality of pages, a plurality of pages including images each having a similarity which is equal to or greater than a predetermined threshold; and a controller that controls a transfer bias to be applied to a transfer device which transfers a toner image formed on an image carrier onto a medium, and that performs control, when toner images corresponding to the plurality of pages specified by the page specifying unit are transferred onto the medium such that the transfer bias to be applied to the transfer device for each of the plurality of pages specified by the page specifying unit is within a predetermined range, and the controller performs control such that a specific transfer bias is separately calculated and applied for each page of a plurality of pages not specified by the page specifying unit.

2. The control apparatus according to claim 1, further comprising:

a toner application amount specifying unit that specifies, for the plurality of pages specified by the page specifying unit, toner application amounts indicating amounts of toner to be transferred onto the medium when forming toner images corresponding to the plurality of pages specified by the page specifying unit, wherein the controller performs control, for the plurality of pages specified by the page specifying unit, such that each of values of the transfer bias to be applied to the transfer device when toner images corresponding to the plurality of pages specified by the page specifying unit are transferred onto the medium is associated with an average value of a maximum value and a minimum value of the toner application amounts specified by the toner application amount specifying unit, or such that each of the values of the transfer bias to be applied to the transfer device when toner images corresponding to the plurality of pages specified by the page specifying unit are transferred onto the medium is within a predetermined range including the average value.

3. An image forming apparatus comprising:

an image carrier;

a charging device that charges a surface of the image carrier;

an exposure device that exposes the surface of the image carrier charged by the charging device to light and forms an electrostatic latent image;

a developing device that stores a developer which includes a toner and a carrier and that develops the electrostatic latent image formed by the exposure device by using the developer so as to form a toner image;

a transfer device that transfers the toner image formed by the developing device to a recording medium;

a page specifying unit that specifies, concerning image data representing images included in a plurality of pages, among the plurality of pages, a plurality of pages including images each having a similarity which is equal to or greater than a predetermined threshold; and a controller that controls a transfer bias to be applied to the transfer device, and that performs control, when toner images corresponding to the plurality of pages specified by the page specifying unit are transferred onto the medium, such that the transfer bias to be applied to the transfer device for each of the plurality of pages specified by the page specifying unit is within a predetermined range, and the controller performs control such that a specific transfer bias is separately calculated and applied for each page of a plurality of pages not specified by the page specifying unit.

4. An image forming system comprising:

an image forming apparatus; and an image processing apparatus that performs image processing on image data which is to be transmitted to the image forming apparatus, the image forming apparatus including an image carrier, a charging device that charges a surface of the image carrier, an exposure device that exposes the surface of the image carrier charged by the charging device to light and forms an electrostatic latent image, a developing device that stores a developer which includes a toner and a carrier and that develops the electrostatic latent image formed by the exposure device by using the developer so as to form a toner image, a transfer device that transfers the toner image formed by the developing device to a recording medium, a page specifying unit that specifies, concerning image data representing images included in a plurality of pages, among the plurality of pages, a plurality of pages including images each having a similarity which is equal to or greater than a predetermined threshold, and a controller that controls a transfer bias to be applied to the transfer device, and that performs control, when toner images corresponding to the plurality of pages specified by the page specifying unit are transferred onto the medium, such that the transfer bias to be applied to the transfer device for each of the plurality of pages specified by the page specifying unit is within a predetermined range, and the controller performs control such that a specific transfer bias is separately calculated and applied for each page of a plurality of pages not specified by the page specifying unit.

5. A control method comprising:

specifying, concerning image data representing images included in a plurality of pages, among the plurality of pages, a plurality of pages including images each having a similarity which is equal to or greater than a predetermined threshold; and controlling a transfer bias to be applied to a transfer device which transfers a toner image formed on an image carrier onto a medium, and performing control, when toner images corresponding to the specified plurality of pages are transferred onto the medium, such that the transfer bias to be applied to the transfer device for each of the specified plurality of pages is within a predetermined range, and performing control such that a specific transfer bias is separately calculated and applied for each page of a plurality of pages that are not the specified plurality of pages.

6. A non-transitory computer readable medium storing a program causing a computer to execute a process, the process comprising:

specifying, concerning image data representing images included in a plurality of pages, among the plurality of pages, a plurality of pages including images each having a similarity which is equal to or greater than a predetermined threshold; and controlling a transfer bias to be applied to a transfer device which transfers a toner image formed on an image carrier onto a medium, and performing control, when toner images corresponding to the specified plurality of pages are transferred onto the medium, such that the transfer bias to be applied to the transfer device for each of the specified plurality of pages is within a predetermined range, and performing control such that a specific transfer bias is separately calculated and applied for each page of a plurality of pages that are not the specified plurality of pages.

7. A control apparatus comprising:

a toner application amount specifying unit that specifies, concerning image data representing images included in a plurality of pages, toner application amounts indicating amounts of toner to be transferred onto a medium by using a transfer device when forming toner images corresponding to the plurality of pages, the transfer device transferring toner images formed on an image carrier onto the medium; and a controller that controls a transfer bias to be applied to the transfer device, and that performs control such that each of values of the transfer bias to be applied to the transfer device when toner images corresponding to the plurality of pages are transferred onto the medium is associated with an average value of a maximum value and a minimum value of the toner application amounts specified by the toner application amount specifying unit, or such that each of the values of the transfer bias to be applied to the transfer device when toner images corresponding to the plurality of pages are transferred onto the medium is within a predetermined range including the average value.

* * * * *